United States Patent [19]

Lorenz

[11] 4,207,730

[45] Jun. 17, 1980

[54] PROCESS AND APPARATUS FOR BULKING TEXTILE YARNS

[75] Inventor: Rainer Lorenz, Nettetal-Breyell, Fed. Rep. of Germany

[73] Assignee: Palitex Project Company GmbH, Krefeld, Fed. Rep. of Germany

[21] Appl. No.: 973,248

[22] Filed: Dec. 26, 1978

[30] Foreign Application Priority Data

Dec. 30, 1977 [DE] Fed. Rep. of Germany ..... 2759022

[51] Int. Cl.[2] ..... D02G 1/18

[52] U.S. Cl. ..... 57/351; 28/247; 28/281; 57/292

[58] Field of Search ..... 28/156, 247, 281; 57/282, 286, 292, 351, 309

[56] References Cited

U.S. PATENT DOCUMENTS

| | | | |
|---|---|---|---|
| 2,823,513 | 2/1958 | Vandamme et al. | 57/284 |
| 3,525,205 | 8/1970 | Antoni et al. | 28/247 X |
| 3,678,142 | 7/1972 | Dubach | 28/247 X |
| 3,721,082 | 3/1973 | Munzner | 57/282 |
| 3,775,814 | 12/1973 | Mayer, Jr. et al. | 28/247 |
| 3,778,873 | 12/1973 | Conti et al. | 57/351 X |
| 3,791,120 | 2/1974 | Hess | 28/247 X |

*Primary Examiner*—John Petrakes

*Attorney, Agent, or Firm*—Bell, Seltzer, Park & Gibson

[57] ABSTRACT

In a process and apparatus for bulking, more particularly high-bulking, of textile yarns having fibers of different shrinkage characteristics including the step of and apparatus for temporarily heating the yarn sufficiently to obtain differential shrinkage and thus bulking of the yarn; the improvement of the steps of and apparatus for soaking the yarn with water and/or other liquid having dielectric properties similar to water while fully and evenly saturating the yarn throughout with a predetermined amount of such liquid, and applying microwave energy to the saturated yarn for heating of the yarn. With this process and apparatus, heating is uniformly applied throughout the yarn and an energy savings can be realized over conventional yarn bulking processes. This process and apparatus may be utilized in conjunction with a two-for-one yarn twisting apparatus in which the process is carried out and the apparatus is disposed between the steps of and the apparatus for twisting and taking-up of the yarn.

17 Claims, 5 Drawing Figures

PROCESS AND APPARATUS FOR BULKING TEXTILE YARNS

FIELD OF INVENTION

This invention relates to a process and apparatus for bulking, more particularly high-bulking, of textile yarn having fibers of different shrinkage characteristics which include the step of and apparatus for temporarily heating the yarn sufficiently to obtain differential shrinkage and thus bulking of the yarn and which are characterized by improved steps and apparatus for heating of the yarn so that the heat is uniformly applied throughout the yarn and an energy savings can be realized over conventional yarn bulking processes.

BACKGROUND OF THE INVENTION

In the bulking of textile yarns having fibers of different shrinkage characteristics, such as a bicomponent yarn or yarns with blends or fibers of different shrinkage characteristics, use is made of such shrinking characteristics of the fibers under the influence of heat. On shrinkage of yarn having fibers of different shrinkage characteristics, a bulking of the yarn develops as a result of the different shrinkage behavoir, thereby yeilding so-called high-bulk yarn.

In order to produce shrinkage in the pre-drafted yarn, it is necessary to supply to each yarn a given amount of heat per unit mass. In this context, the yarn has to be maintained at the shrinking temperature for a given length of time which is a function of the material and the degree of the temperature.

In accordance with currently known yarn bulking processes (see for example German Offenlegungsschrift No. 20 39 273) the thermal energy required is supplied in wet or dry form to the yarns required to be bulked. Two basically different process variants are used for this. In one, a large volume of yarn is subjected in batches to the shrinking process (commonly known as the hank method), while the other comprises application of a continuous shrinking heat treatment to moving individual yarns, for example during a spooling and/or twisting process. A distinction is generally made between the following two variants in respect of process technology. One comprises a short period high temperature treatment of about 130° C. with hot air or superheated steam. A frequently used process for this comprises the use of radiant heaters with wall temperatures of up to 300° C. The other comprises a low temperature treatment at about 100° C. applied over extended periods and predominantly carried out with hot water.

These two methods have in common the circumstance that the heat is supplied to the yarn from the surface thereby rendering the poor thermal conductivity of the textile yarn the governing parameter. The efficiency of energy transfer through heating from the surroundings is hence very low. This is shown up by the feature that the wall termperature of the machine components through which the heat is transmitted is frequently very much higher than that of the yarn which, even during the high temperature treatment, is thought to barely reach the above-mentioned 130° C.

Causing of this shrinkage by the use of hot water has been considered additionally beneficial when the fibers of the yarn have high-polymer molecules which have a specific affinity to water so that the water may act as an inter-molecular catalyst as a function of the existing temperature and diffusion conditions.

Accordingly, problems have heretofore existed with respect to efficient heating of yarn having fibers of different shrinkage characteristics for obtaining differential shrinkage and thus bulking of the yarns.

SUMMARY OF THE INVENTION

Accordingly, it is the object of this invention to provide an improved method and apparatus for bulking, more particularly high-bulking, of textile yarn having fibers of different shrinkage characteristics, including the step of and apparatus for temporarily heating the yarn sufficiently to obtain differential shrinkage and thus bulking of the yarn, by overcoming the problems heretofore existing with respect to inefficient heating of the yarn.

By this invention, it has been found that the above object may be accomplished by providing, in such a process and apparatus, the improvements of the steps of and apparatus for (1) soaking the yarn with water and/or other liquid having dielectric properties similar to water while fully and evenly saturating the yarn throughout with a predetermined amount of such liquid, and (2) applying microwave energy to the saturated yarn for the heating of the yarn. With this process and apparatus, the heating is uniformly applied throughout the yarn and an energy savings can be realized over conventional yarn bulking processes.

Although prior art processes and apparatus have been proposed for heating-up of continuously running yarns by way of microwave energy, such as for example those which have been described in German Offenlegungsschriften Nos. 20 29 183 and 20 47 120, these processes differ from the process of the present invention in the following respects.

In the process described in German Offenlegungsschrift No. 20 29 183, a yarn made from a dielectric material is passed without making direct contact through a microwave heating unit for the purpose of drying the yarn through rapid heating-up, i.e. to remove from the yarn any residual moisture which may persist from previous process stages.

In the process described in German Offenlegungsschrift No. 20 47 120, the yarn is also heated up with the object of drying it.

Accordingly, these processes do not utilize microwave energy for the purpose of high-bulking of the yarn and such high-bulking of the yarn would not be possible in these prior art processes because of the omission of a step of or apparatus for deliberately soaking of the yarn with water and/or other liquid having dielectric properties similar to water while fully and evenly saturating the yarn throughout with a predetermined amount of such liquid, which is necessary for obtaining the desired uniform heating for bulking which is obtained by the process and apparatus of the present invention. The combination of adequate saturation of the yarn followed by the application of microwave energy for heating-up of the yarn and initiating the differential shrinkage are the features required for the effective implementation of the method and apparatus in accordance with this invention.

BRIEF DESCRIPTION OF THE DRAWINGS

Some of the objects and advantages of this invention having been set forth, other objects and advantages will appear when taken in conjunction with the accompanying drawings, in which.

DESCRIPTION OF PREFERRED EMBODIMENTS

Figure 1:
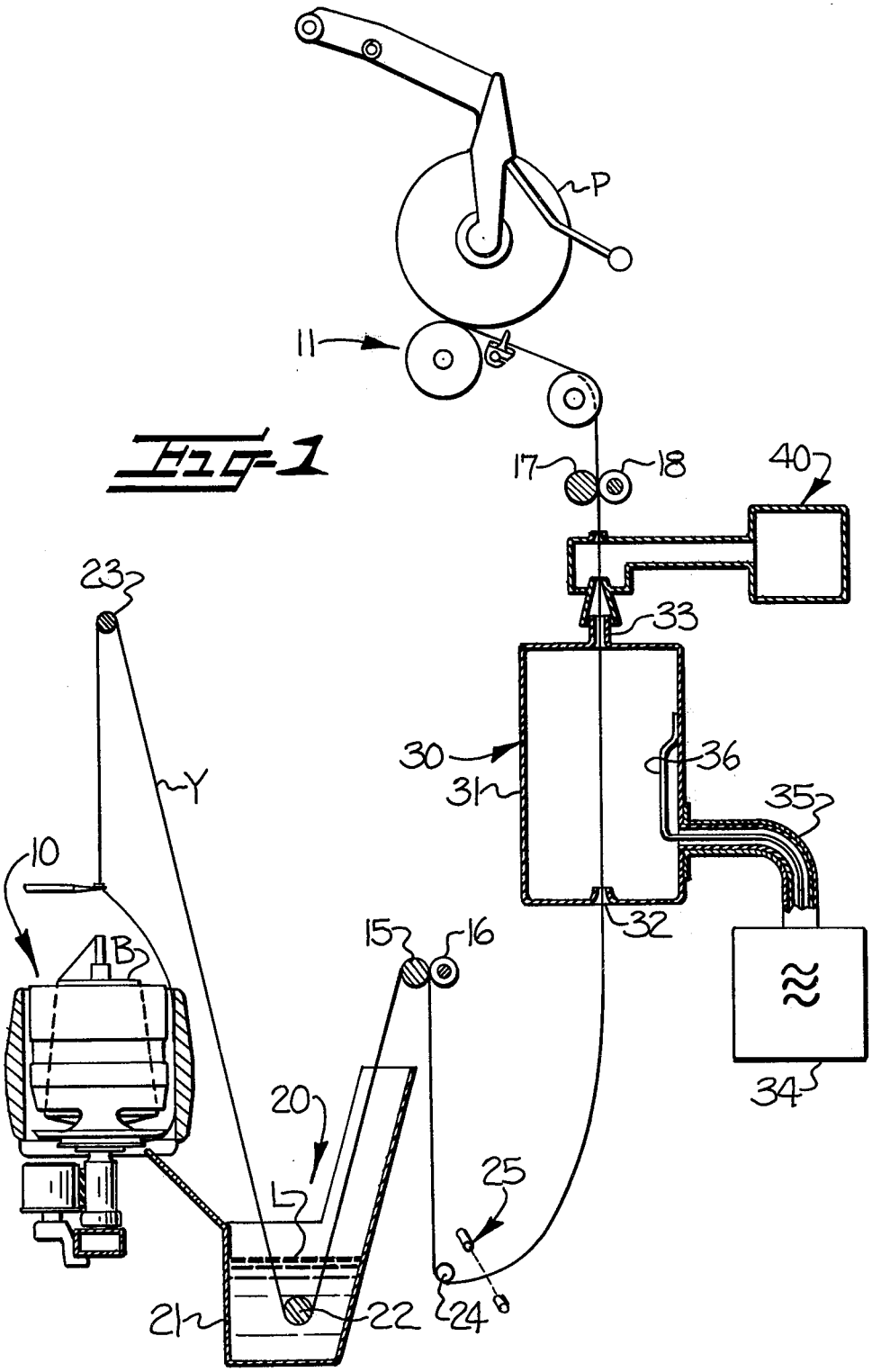
FIG. 1 is a schematic, sectional view taken through a first embodiment of apparatus in accordance with this invention.

In the drawings, there are illustrated three embodiments of apparatus for bulking of textile yarn constructed in accordance with this apparatus, i.e. FIG. 1, FIGS. 2–4, and FIG. 5. These embodiments of bulking apparatus are shown schematically as being utilized in a two-for-one twister textile yarn processing machine; however, it is to be understood that this improved yarn bulking apparatus may be utilized alone or in combination with other machines. Also, it is to be understood that the improved process of this invention could utilize other embodiments of apparatus other than the three embodiments illustrated in the drawings.

Referring now to the first embodiment of apparatus constructed in accordance with this invention and illustrated in FIG. 1, there is shown therein a spindle assembly 10 of a conventional two-for-one twister textile yarn processing machine which includes a supply bobbin B of yarn Y which is processed in such spindle assembly 10 for inserting a two-for-one twist in the yarn Y withdrawn from the bobbin B in a manner well understood by those with ordinary skill in the art. Accordingly, a full description and illustration of the spindle assembly 10 of the two-for-one twister textile yarn processing machine is not given herein and is not believed to be necessary for a full understanding of this invention. The two-for-one twister textile yarn processing machine also conventionally includes a take-up mechanism 11 for taking-up the yarn Y, after processing in the spindle assembly 10 for inserting the two-for-one twist therein, and for forming a take-up package P of processed yarn Y.

As further shown in FIG. 1, the improved apparatus for bulking of the textile yarn Y in accordance with this invention is illustrated therein and includes first driven feeding means comprising a pair of driven superimposed rolls, 15, 16 for feeding of the yarn Y from the yarn supply means, which in the case of the apparatus illustrated in FIG. 1 is the bobbin B within the spindle assembly 10. The improved yarn bulking apparatus further includes second driven feeding means comprising a pair of superimposed driven rolls 17, 18 for feeding of the yarn Y from the first yarn feeding means 15, 16. These rolls 15, 16 and 17, 18 may be of any convenient, conventional type of feed rolls and may be driven by any suitable drive mechanism, the details of which are not necessary for an understanding of the present invention. The drive for the second feeding means 17, 18 is coordinated with the drive for the first yarn feeding means 15, 16 for maintaining the yarn Y between the two yarn feeding means in a substantially non-tensioned condition which is necessary for the bulking of the yarn which will be described below. This coordination of the drive means may be accomplished by any suitable mechanical means, the details of which may be easily designed by one with ordinary skill in the art and are not necessary for an understanding of the present invention.

The rolls 15, 16 of the first yarn feeding means may also be utilized as squeegee-type rolls for removing excess liquid L from the yarn Y as it passes therethrough.

The yarn bulking apparatus further includes means 20 positioned between the yarn supply means 10 and the first yarn feeding means 15, 16 for soaking the yarn Y with water and/or other liquid having dielectric properties similar to water for fully and evenly saturating the yarn throughout with a predetermined amount of such liquid. The means 20 may comprise a tank 21 filled with such liquid L and having a guide roller 22 therein for guiding the yarn Y through the liquid L within the tank 21 after the yarn Y passes over another guide roller 23 as it emerges from the spindle assembly 10.

The yarn bulking apparatus further includes another guide roller 24 for guiding the yarn Y after passage through the first yarn feeding means 15, 16 through a sensing mechanism 25 for sensing the sag of the yarn Y and controlling the first feeding means 15, 16 to ensure that the yarn Y is being fed in a substantially non-tensioned condition between the first yarn feeding means 15, 16 and the second yarn feeding means 17, 18. This sensing means 25 may be in the form of any convenient, conventional photoelectric sensing mechanism or otherwise which is operatively associated with the first yarn feeding means 15, 16 for controlling the drive thereof. This may be accomplished by any convenient mechanical or electrical mechanism, which could be designed by anybody with ordinary skill in the art and the details of which are not necessary for an understanding of the present invention.

The yarn bulking apparatus further includes means 30 positioned between the first and second yarn feeding means 15, 16 and 17, 18 for receiving and passing the saturated yarn Y therethrough in the substantially non-tensioned condition and for applying microwave energy to the saturated yarn Y during such passage for uniform heating of the yarn Y throughout. In the embodiment of FIG. 1, this means 30 comprises a substantially enclosed microwave resonator 31 having an inlet 32 in one end thereof and an outlet 33 at the other end thereof for receiving and passing the non-tensioned yarn therethrough by the shortest route as the yarn Y is being fed by the second yarn feeding means 17, 18. This microwave resonator 31 may, for example, be in the form of a 100 mm long and 60 mm diameter cavity resonator. Associated with the resonator 31 is a microwave generator 34 for supplying energy in the required GHz range through a coaxial cable 35 and a magnetic loop coupling means 36 into the resonator 31. The construction and operation of such a microwave generator and resonator is well understood by those with ordinary skill in the art and further detailed explanation herein is not deemed necessary. The power supply to the microwave resonator 31 and therewith the frequency of the microwave resonator and the length of the microwave resonator and the yarn traveling speed through the resonator 31 are matched in relation to one another so that the yarn Y, virtually fully saturated with liquid L in the means 20, is shrunk to the desired extent by the heat supplied in the microwave resonator 31 and leaves the microwave resonator 31 in a dry state.

The yarn bulking apparatus may further include a steam extraction unit 40 constructed in any suitable manner for drawing off the vapors produced in the microwave resonator 30 and is attached to an end of the microwave resonator, as shown schematically in FIG. 1.

The yarn Y is then withdrawn by the second yarn feeding means 17, 18 and is received by the take-up mechanism 11 for being wound into a package P of processed and bulked yarn Y.

It should be noted here that the drawings are not to scale inasmuch as the microwave resonator and other means forming the yarn bulking apparatus of this invention are shown larger and exagerated for clarity.

Figure 2:
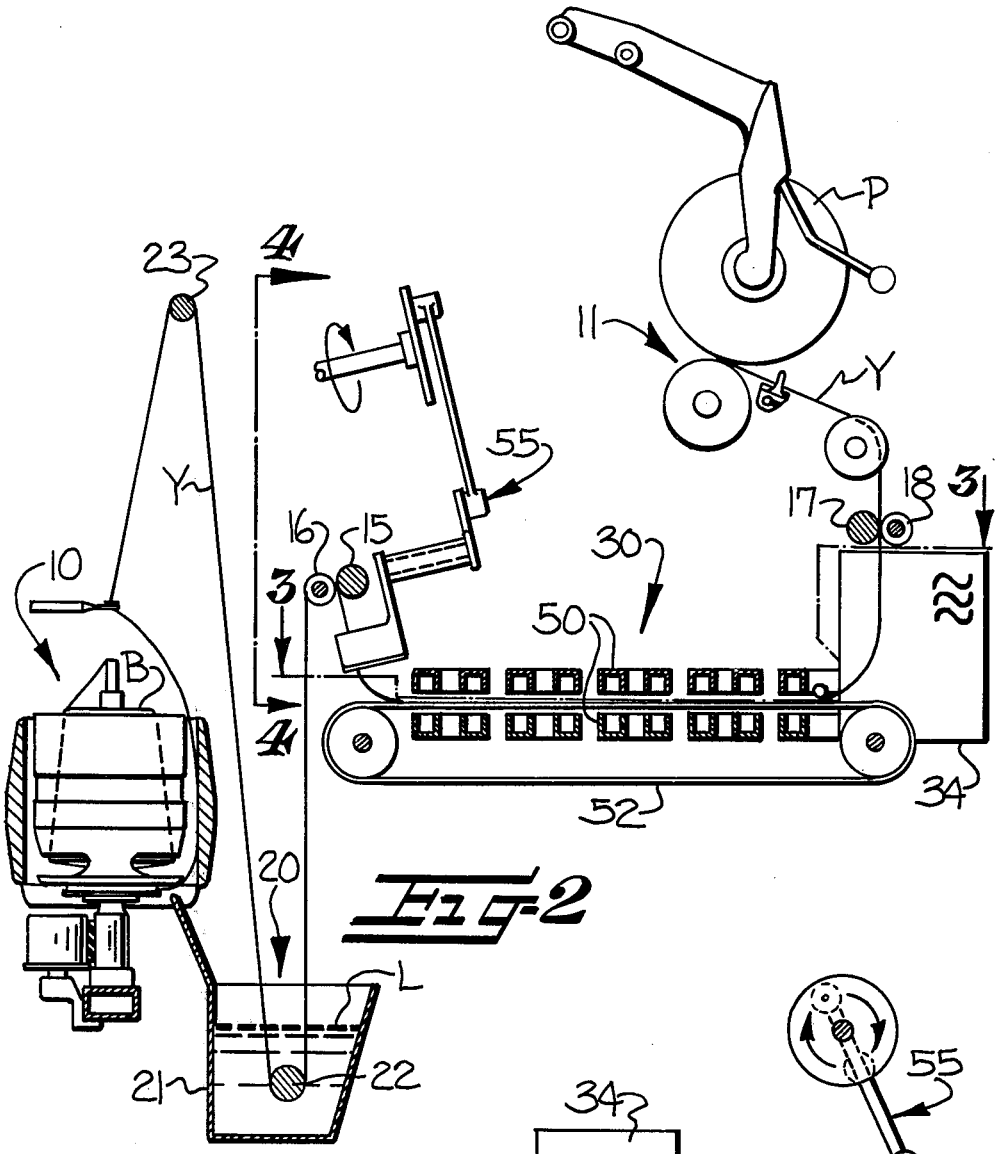
FIG. 2 is a schematic, sectional view taken through a second embodiment of apparatus in accordance with this invention.
Figure 3:
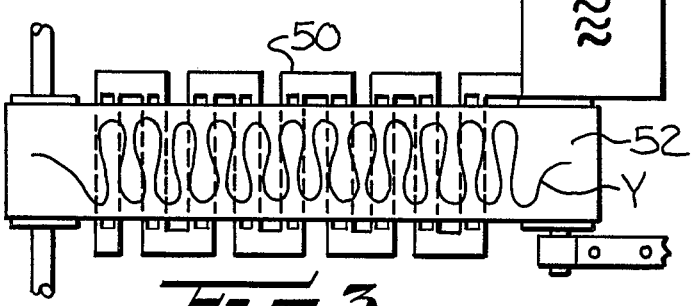
FIG. 3 is a schematic, sectional view, taken generally along the line 3—3 of FIG. 2.
Figure 4:
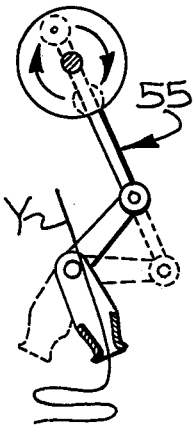
FIG. 4 is a schematic, sectional view, taken generally along the line 4—4 of FIG. 2.

Referring now to the second embodiment of apparatus constructed in accordance with this invention, as illustrated in FIGS. 2–4, this apparatus includes certain like mechanisms to that of the first embodiment of FIG. 1 and for those like mechanisms, like reference numerals have been applied to the drawings. Basically, the embodiment of yarn bulking apparatus of FIGS. 2–4 differs from that of the embodiment of FIG. 1 in the means 30 positioned between the first and second yarn feeding means 15, 16 and 17, 18 for receiving and passing the saturated yarn Y therethrough in the substantially non-tensioned condition and for applying microwave energy to the saturated yarn Y during such passage for uniform heating of the yarn throughout. This means 30 in the embodiment of FIGS. 2–4 comprises a meandering, laterally-slotted, wave guide section 50 connected with the microwave generator 34 for receiving microwave energy therein. Cooperating with the wave guide section 50 is a driven, dielectrically-inert, conveyor belt mechanism 52 mounted on a pair of driven rolls 53 in a position such that the upper flight thereof passes through the wave guide section 50, as illustrated clearly in FIG. 2, and so that yarn Y deposited on the upper flight of the conveyor belt 52 will receive microwave energy from the lateral slots of the wave guide section 50.

The saturated yarn Y is deposited onto the upper flight of the conveyor belt 52 by means of a transverse motion, yarn depositing unit 55 which may be of any convenient mechanical construction, such as that illustrated in FIG. 4, for depositing of the saturated, substantially non-tensioned yarn Y received from the first yarn feeding means 15, 16 in a meandering form on the upper flight of the conveyor belt mechanism 50. By this arrangement, an adequate dwell time for the yarn as it is being passed through the microwave energy by the conveyor belt mechanism 50 is ensured.

Figure 5:
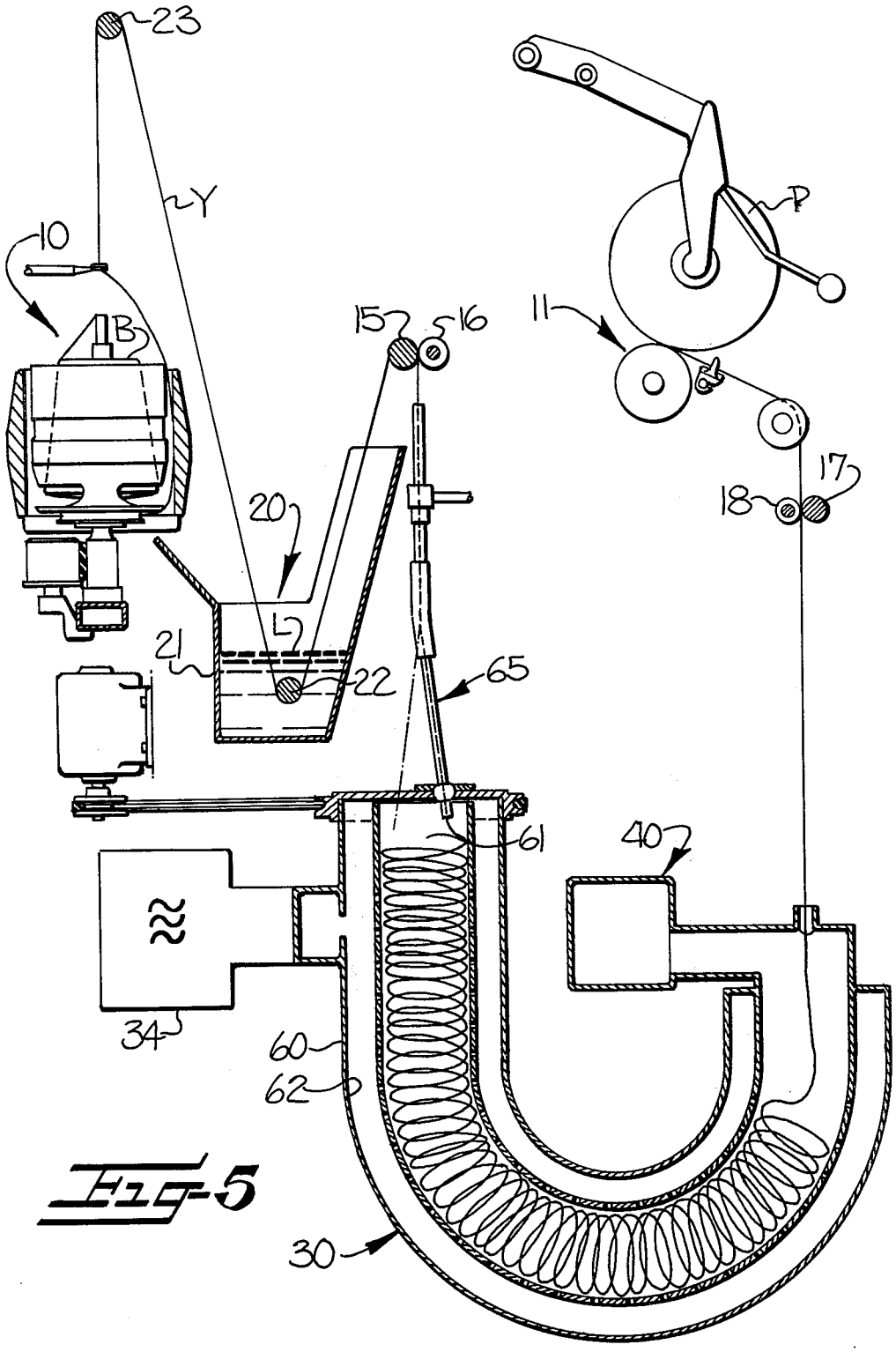
FIG. 5 is a schematic, sectional view of a third embodiment of apparatus in accordance with this invention.

Referring now to the embodiment of yarn bulking apparatus illustrated in FIG. 5, this third embodiment of such apparatus includes similar components to those illustrated in the respective embodiments of FIG. 1 and FIGS. 2–4 and like reference characters have been applied in the drawings to like components.

The basic difference between the yarn bulking apparatus of the embodiment of FIG. 5 and that of the embodiments of FIG. 1 and FIGS. 2–4 is the means 30 positioned between the first and second yarn feeding means 15, 16 and 17, 18 for receiving and passing the saturated yarn Y therethrough in the substantially non-tensioned condition and for applying microwave energy to the saturated yarn Y during such passage for uniform heating of the yarn throughout.

In the embodiment of FIG. 5, this means 30 comprises a hollow storage chamber 60 which may be of generally J-shaped configuration and having an internal yarn receiving section 61 and an internally-slotted wave guide section 62 for receiving microwave energy from the microwave generator 34 therein and surrounding the yarn receiving section 61 for applying the microwave energy therein through the internal slots.

For depositing the saturated yarn Y in the substantially non-tensioned condition within the yarn receiving section 61 of the chamber 60, there is provided a yarn depositing device 65, which may be constructed as illustrated in FIG. 5, for receiving the saturated yarn Y from the first yarn feeding means 15, 16 and depositing the yarn Y in batch form of generally a coiled configuration in the yarn receiving section 61 so that the yarn will pass therethrough and be fed thereout by the second yarn feeding means 17, 18 and in which an adequate dwell time for the yarn Y will be ensured by such arrangement as the yarn Y is passed through the microwave energy.

With the above-described three embodiments of yarn bulking apparatus constructed in accordance with this invention, as well as other constructions of apparatus, a process for bulking, more particularly high-bulking, of textile yarns having fibers of different shrinkage characteristics, including the step of temporarily heating the yarn sufficiently to obtain differential shrinkage and thus bulking of the yarn, is employed.

The textile yarn having fibers of different shrinkage characteristics may be a bi-component yarn or a yarn with blends of fibers of different shrinkage characteristics, such as a blend of from 40% of type 42, 3, 3 dtex, bride, ORLON acrylic fibers and from 60%, type 42, 2,4 dtex, matt, ORLON acrylic fibers, already relaxed, manufactured by DuPont, or 100% type 21, bi-component, 6,6 dtex, bride, ORLON acrylic fibers manufactured by DuPont, etc.

This textile yarn having fibers of different shrinkage characteristics is first soaked with water and/or other liquids having dielectric properties similar to water while fully and evenly saturating the yarn throughout with a predetermined amount of such liquid. Such other liquids may include glycerine, ethylene glycol, formic acid, nitro benzene, etc., all having dielectric properties similar to water. These liquids may be used separately or mixed together for obtaining desired full and even saturation of the yarn throughout with such liquid. Preferably, the yarn should be saturated with a moisture content of between 30% to 150% by weight of the yarn mass.

Next, microwave energy is applied to the saturated yarn for heating of the yarn. The yarn is passed through the microwave energy in a substantially non-tensioned condition and at a rate of preferably from about 20 to 200 m/min in a substantially linear path of travel for obtaining the shortest route for the yarn therethrough. This would preferably be done with a heating apparatus 30 such as illustrated in the first embodiment of apparatus in accordance with this invention of FIG. 1. This rate of travel is preferably at about 50–70 m/min. With the use of the heating means 30 of the second embodiment of FIGS. 2–4 of the drawings, the yarn could be passed through the microwave energy at a rate up to 200 m/min and higher since the yarn is deposited in a meandering form to ensure an adequate dwell time for the yarn within the microwave energy.

The combination of adequate saturation of the yarn with the liquid coupled with a subsequent microwave treatment for heating up and initiating the differential shrinking of the fibers in the yarn are the features required for the effective implementation of the process in accordance with this invention. In this process, the liquid absorbed uniformly and thoroughly throughout the yarn absorbs the microwave energy and immediately and uniformly heats the yarn over its entire volume very rapidly. As a result of the intimate contact between the water or other liquid and the individual fibers making up the yarn, this heat is uniformly delivered over the full yarn cross-section. The heating-up of yarn by heating-up of the volume of water or other liquid located between the various fibers of the yarn may be regarded as the fastest method for heating-up the yarns and thus provides an energy savings over previously used heating apparatus in yarn bulking mechanisms. The generation of heat in the yarn is automatically terminated once all of the water or other liquid has been driven off or evaporated and the yarn leaves the microwave energy in a virtually dry state.

This improved process of the present invention may preferably be utilized in a process for imparting a two-for-one twist to a textile yarn having fibers of different shrinkage characteristics and which process includes feeding of the yarn from a supply, twisting of the yarn to impart a two-for-one twist and taking-up of the twisted yarn, wherein the improved bulking process of this invention is utilized between the twisting and the taking-up steps of the twisting process.

In the drawings and specification, there have been set forth preferred embodiments of this invention, and although specific terms are employed, they are used in a generic and descriptive sense only and not for purposes of limitation.

What is claimed is:

1. In a process for bulking, more particularly high-bulking, of textile yarn having fibers of different shrinkage characteristics including the step of temporarily heating the yarn sufficiently to obtain differential shrinkage and thus bulking of the yarn; the improvement of:

soaking the yarn with water and/or other liquid having dielectric properties similar to water while fully and evenly saturating the yarn throughout with a predetermined amount of such liquid; and applying microwave energy to the saturated yarn for said heating of the yarn;

whereby, said heating is uniformly applied throughout the yarn and an energy savings can be realized over conventional yarn bulking processes.

2. In a process, as set forth in claim 1, in which said soaking step comprises saturating the yarn with an amount of the liquid of 30 to 150% by weight of the yarn.

3. In a process, as set forth in claim 1, further including passing the yarn through the microwave energy in a substantially non-tensioned condition.

4. In a process, as set forth in claim 1, further including passing the yarn through the microwave energy at a rate of 20 to 200 m/min in a substantially linear path of travel for obtaining the shortest route for the yarn therethrough.

5. In a process, as set forth in claim 4, in which said passing of the yarn through the microwave energy comprises a preferred rate of 50–70 m/min.

6. In a process, as set forth in claim 1, further including feeding the yarn into and withdrawing the yarn from the microwave energy at a rate up to 200 m/min and higher while depositing the yarn in a meandering form therein to ensure an adequate dwell time for the yarn within the microwave energy.

7. In a process, as set forth in claim 1, further including depositing the yarn in the microwave energy in batches to ensure an adequate dwell time for the yarn within the microwave energy.

8. In a process, as set forth in claim 1, in which said soaking step comprises soaking the yarn with a water/glycerine mixture.

9. In a process for imparting a two-for-one twist to a textile yarn having fibers of different shrinkage characteristics including feeding of the yarn from a supply, twisting of the yarn to impart a two-for-one twist and taking up of the twisted yarn; the combination therewith of bulking the yarn between said twisting and said taking-up by temporarily heating the yarn sufficiently to obtain differential shrinkage and thus bulking of the yarn, characterized by soaking the yarn with water and/or other liquid having dielectric properties similar to water while fully and evenly saturating the yarn throughout with such liquid; and applying microwave energy to the saturated yarn for said heating of the yarn.

10. In a process, as set forth in claim 9, in which said soaking step comprises saturating the yarn with an amount of the liquid of 30% to 150% by weight of the yarn.

11. In an apparatus for bulking, more particularly high-bulking, of textile yarn having fibers of different shrinkage characteristics including means for temporarily heating the yarn sufficiently to obtain differential shrinkage and thus bulking of the yarn; the improvement of:

yarn supply means for supplying of the yarn to be bulked;

first driven feeding means for feeding the yarn from said supply means;

second driven feeding means for feeding the yarn from said first yarn feeding means and being coordinated with said first yarn feeding means for maintaining the yarn in a substantially non-tensioned condition between said first and second yarn feeding means;

means positioned between said supply means and said first yarn feeding for soaking the yarn with water and/or other liquid having dielectric properties similar to water for fully and evenly saturating the yarn throughout with a predetermined amount of such liquid; and said heating means comprising means positioned between said first and second yarn feeding means for receiving and passing the saturated yarn therethrough in the substantially non-tensioned condition and for applying microwave energy to the saturated yarn during such passage for uniform heating of the yarn throughout;

whereby, an energy saving can be realized with said heating means over conventional yarn bulking heating means by the uniform heating of the yarn throughout.

12. In an apparatus, as set forth in claim 11, further including means positioned subsequent to said yarn soaking means for removing excess liquid from the yarn after soaking thereof.

13. In an apparatus, as set forth in claim 12, in which said first yarn feeding means and said excess liquid removal means comprises a pair of driven, superimposed rolls for receiving and feeding of the yarn therebetween and for acting as squeegee rolls for removing excess liquid from the yarn.

14. In an apparatus, as set forth in claim 11, in which said heating means for applying mircrowave energy to the saturated yarn comprises a substantially enclosed microwave resonator having an inlet in one end thereof and an outlet at the other end thereof for receiving and passing the non-tensioned yarn therethrough by the shortest route as the yarn is being fed by said second yarn feeding means.

15. In an apparatus, as set forth in claim 11, in which said heating means for applying microwave energy to the saturated yarn comprises a microwave generator, meandering, laterally-slotted, wave guide section connected with said microwave generator for receiving microwave energy therein, a driven, electrically-inert, conveyor belt means having the upper flight thereof positioned for passage through said wave guide section, and yarn depositing means positioned for receiving the saturated yarn from said first yarn feeding means and depositing the yarn on the upper flight of said conveyor in meandering form to ensure adequate dwell time for the yarn as it is being passed through the microwave energy by said conveyor belt means.

16. In an apparatus, as set forth in claim 11, in which said heating means for applying microwave energy to the saturated yarn comprises a microwave generator, a hollow storage chamber device having an internal yarn receiving section and an internally-slotted wave guide section connected with said microwave generator for receiving microwave energy therein and surrounding said yarn receiving section for applying the microwave energy therein, and yarn depositing means positioned for receiving the saturated yarn from said first yarn feeding means and depositing the yarn in batch form in said yarn receiving section to pass therethrough and to be fed thereout by said second yarn feeding means and to ensure adequate dwell time for the yarn as it is being passed through the microwave energy.

17. In a two-for-one twisting apparatus for processing textile yarn having fibers of different shrinkage characteristics including means for imparting a two-for-one twist to the yarn and means for taking-up of the twisted yarn; the combination therewith of apparatus for bulking the yarn between said twisting means and said take-up means including means for temporarily heating the yarn sufficiently to obtain differential shrinkage and thus bulking of the yarns; the improvement of:

first driven feeding means positioned between said means for twisting of the yarn and said take-up means for feeding of the yarn from said yarn twisting means;

second driven feeding means positioned between said first yarn feeding means and said take-up means and being coordinated with said first yarn feeding means for maintaining the yarn in a substantially non-tensioned condition between said first and second yarn feeding means;

means positioned between said yarn twisting means and said first yarn feeding means for soaking the yarn with water and/or other liquid having dielectric properties similar to water for fully and evenly saturating the yarn throughout with a predetermined amount of such liquid; and said heating means comprising means positioned between said first and second yarn feeding means for receiving and passing the saturated yarn therethrough in the substantially non-tensioned condition and for applying microwave energy to the saturated yarn during such passage for uniform heating of the yarn throughout, whereby, an energy savings can be realized with said heating means over conventional yarn bulking heating means by the uniform heating of the yarn throughout.

* * * * *

UNITED STATES PATENT AND TRADEMARK OFFICE

CERTIFICATE OF CORRECTION

PATENT NO. : 4,207,730

DATED : June 17, 1980

INVENTOR(S) : Rainer Lorenz

It is certified that error appears in the above-identified patent and that said Letters Patent are hereby corrected as shown below:

Column 1, line 21, delete "or", second occurrence, and insert therefor --of--; Column 9, line 27, "electrically-inert" should be --dielectrically-inert--.

Signed and Sealed this

*Fourteenth* Day of *October 1980*

[SEAL]

*Attest:*

SIDNEY A. DIAMOND

*Attesting Officer*

*Commissioner of Patents and Trademarks*